US010976035B2

(12) United States Patent
Joyce

(10) Patent No.: US 10,976,035 B2
(45) Date of Patent: Apr. 13, 2021

(54) FLARE STAND

(71) Applicant: SBI Smart Brands International (America) Ltd., Vaughn (CA)

(72) Inventor: Michael Joyce, Richmond Hill (CA)

(73) Assignee: SBI Smart Brands International (America) Ltd., Vaughan (CA)

( * ) Notice: Subject to any disclaimer, the term of this patent is extended or adjusted under 35 U.S.C. 154(b) by 0 days.

(21) Appl. No.: 16/526,269

(22) Filed: Jul. 30, 2019

(65) Prior Publication Data

US 2021/0033269 A1 Feb. 4, 2021

(51) Int. Cl.

| | |
|---|---|
| ***F21L 17/00*** | (2006.01) |
| ***F21V 21/30*** | (2006.01) |
| ***G08B 5/36*** | (2006.01) |
| *F21W 111/00* | (2006.01) |

(52) U.S. Cl.

CPC ..... *F21V 21/30* (2013.01); *G08B 5/36* (2013.01); *F21W 2111/00* (2013.01)

(58) Field of Classification Search

CPC ..... F21V 21/14; F21V 21/145; F21V 21/30; G08B 5/36; F21L 17/00

See application file for complete search history.

(56) References Cited

U.S. PATENT DOCUMENTS

2015/0034506 A1* 2/2015 Hwang ..... F16M 13/022 206/223

* cited by examiner

*Primary Examiner* — Sean P Gramling
(74) *Attorney, Agent, or Firm* — McMillan LLP

(57) ABSTRACT

A flare stand is provided. The flare stand has a first stand member and a second stand member rotatable with respect to the first stand member between an open working position and a folded position. In the open working position, the flare stand is configured for supporting a flare in a substantially upright position. In the folded position, the first and second stand members substantially overlap in the vertical plane for a reduced footprint of the flare stand. A flare support structure, arranged on the second stand member is configured for supporting the flare in the upright position. The first and second stand members engage a ground surface in the open working position to maintain the flare in the upright position. The flare stand is used to hold a flare in the upright position, but may be folded into the reduced footprint device for storage.

21 Claims, 12 Drawing Sheets

FLARE STAND

TECHNICAL FIELD

The present disclosure relates generally to holders and stands, and more specifically to a flare stand.

BACKGROUND

Electronic flares, which also double as flashlights, are becoming popular. Flares are typically used to signal a hazard or an emergency condition, such as an accident or a large pothole. A flare is placed at or near the hazard, and are expected to last for a few hours at least. Electronic flares are safer to use than regular flares and can provide multiple functions. For example, an electronic flare may feature an emergency flashing light mode, and a flashlight. In case of an emergency, the electronic flare needs to be placed on the ground in an upright position with the lighting end elevated from the ground.

To keep an electronic flare in an upright position, a base or a stand is needed. Some weather conditions such as strong wind may cause the flare to tip over or to be moved out of its place. Additionally, a large or bulky flare stand would discourage users from carrying that stand in their vehicles, as it would take up too much storage space.

It is desirable to have a flare stand that addresses at least some of the aforementioned issues.

SUMMARY

In one aspect of the present disclosure, there is provided a flare stand. The flare stand comprises a first stand member and a second stand support member. Each of the first stand member and the second stand member has a base portion and a support portion extending from the base portion. The base portion of the second stand member is pivotally coupled with the base portion of the first stand member and is rotatable with respect thereto between an open working mode in which the flare stand is configured for supporting a flare on a ground surface, and a folded position in which the first and second stand members substantially overlap in the vertical plane for a reduced footprint of the flare stand. A flare support structure is arranged on the base portion of the second stand member and configured for supporting a flare in a substantially upright position. The first and second support portions members are each dimensioned to engage the ground surface such that the flare stand maintains the flare in the substantially upright position when the flare stand is in the open working position.

In one embodiment, the flare support structure comprises a plurality of upstanding members arranged for receiving an end portion of the flare to support and retain the flare in the substantially upright position.

In one embodiment, the flare support structure is arranged to be substantially centrally positioned with respect to the flare stand in the open mode.

In one embodiment, the first and second stand members are substantially planar.

In one embodiment, the first and second support portions are angled with respect to the respective first and second base portions, such that the first and second base portions are elevated from the ground surface in the open working position.

In one embodiment, in the folded position, the first and second stand members fully overlap in the vertical plane and the reduced footprint of the flare stand is substantially the same as a footprint of one of the first and the second stand members.

In one embodiment, first and second base support portions each comprises at least one leg for supporting the flare stand above ground in the open working mode.

In one embodiment, the at least one leg comprises a plurality of teeth configured to grip the ground on which the flare stand is placed.

In one embodiment, the plurality of teeth may be disposed along a periphery of the distal end portion of the support portion of each of the first and the second stand members.

In one embodiment, the base portion of the second stand member comprises a circular aperture, and the base portion of the first stand member comprises a circular protrusion sized to fit in the circular aperture to form a pivot connection between the first and the second stand members.

In one embodiment, the flare stand further comprises a fastening assembly configured for pivotally securing the first stand member to the second stand member.

In one embodiment, the fastening assembly comprises a flare support plate having a central hole and sized to fit within the flare support structure, and a fastener, sized for passing through the central hole and fastening into a hub formed in the circular protrusion.

In one embodiment, in the folded position, the first stand member is positioned below the second stand member.

In one embodiment, the flare stand further comprises a third stand member having a base portion and a support portion extending from the base portion. The base portion of the third stand member is pivotally coupled with the base portion of each of the first and second base stand members.

In one embodiment, in the folded position: the third stand member is positioned below the second stand member and the first stand member is positioned below the third stand member.

In one embodiment, the first, second, and third support portions each comprises at least one leg near a distal end portion of the support portion thereof for supporting the flare stand above ground in the open working position.

In one embodiment, the at least one leg comprises a plurality of teeth configured to grip the ground surface on which the flare stand is placed.

In one embodiment, the plurality of teeth are disposed along a periphery of the distal end portion of the support portion of each of the first, second, and third stand members.

In one embodiment, in the folded position, the first, second and third stand members fully overlap in the vertical plane and the reduced footprint of the flare stand is substantially the same as the footprint of one of the first, second, and third stand members.

In one embodiment, the second stand member further comprises a first stop means for stopping the third stand member at a specific position in the open working position when the third stand member is pivotally moved from the folded position to the open working position.

In one embodiment, the third stand member further comprises a second stop means for stopping the first stand member at a specific position in the open working position when the first stand member is pivotally moved from the folded position to the open working position.

BRIEF DESCRIPTION OF THE DRAWINGS

Embodiments of the present disclosure will be presented with reference to the attached drawings in which.

DETAILED DESCRIPTION OF THE EMBODIMENT

Embodiments of the present disclosure are presented below by way of example only and not limitation.

Figure 1:
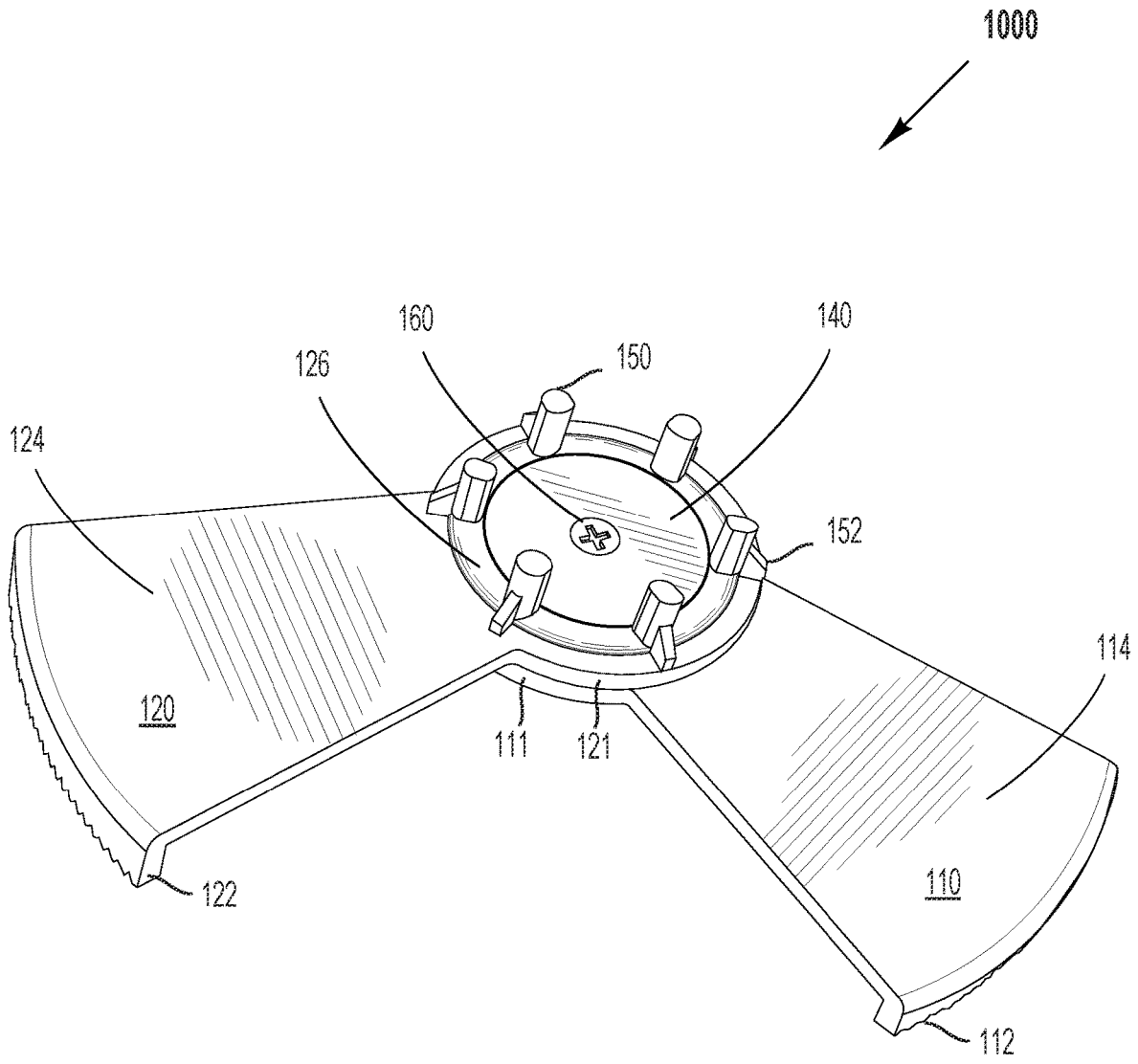
FIG. 1 is a top perspective view of a flare stand having two stand members in an open mode, in accordance with an embodiment of the present disclosure.
Figure 2:
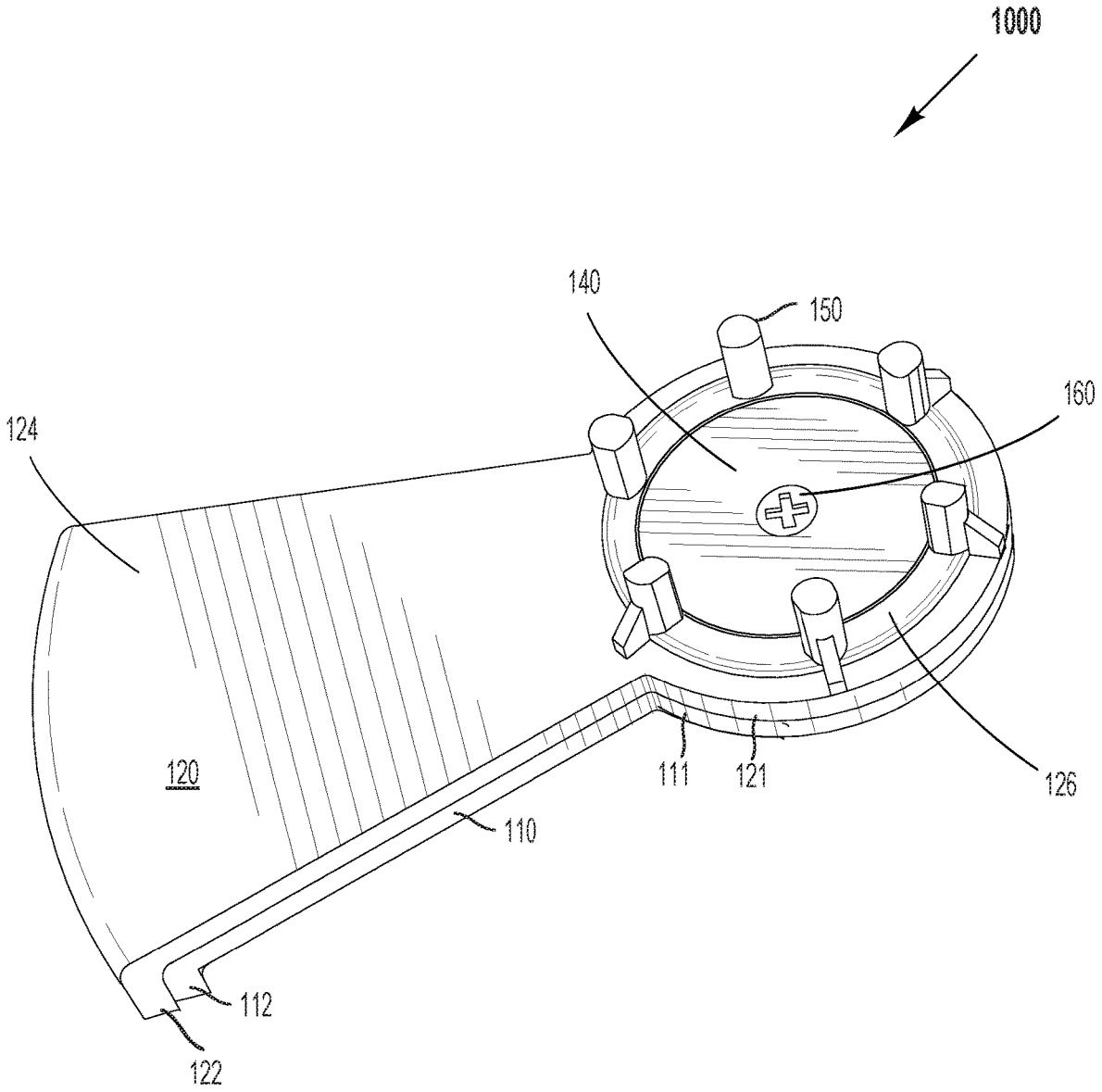
FIG. 2 is a top perspective view of the flare stand of FIG. 1, in closed mode.
Figure 3:
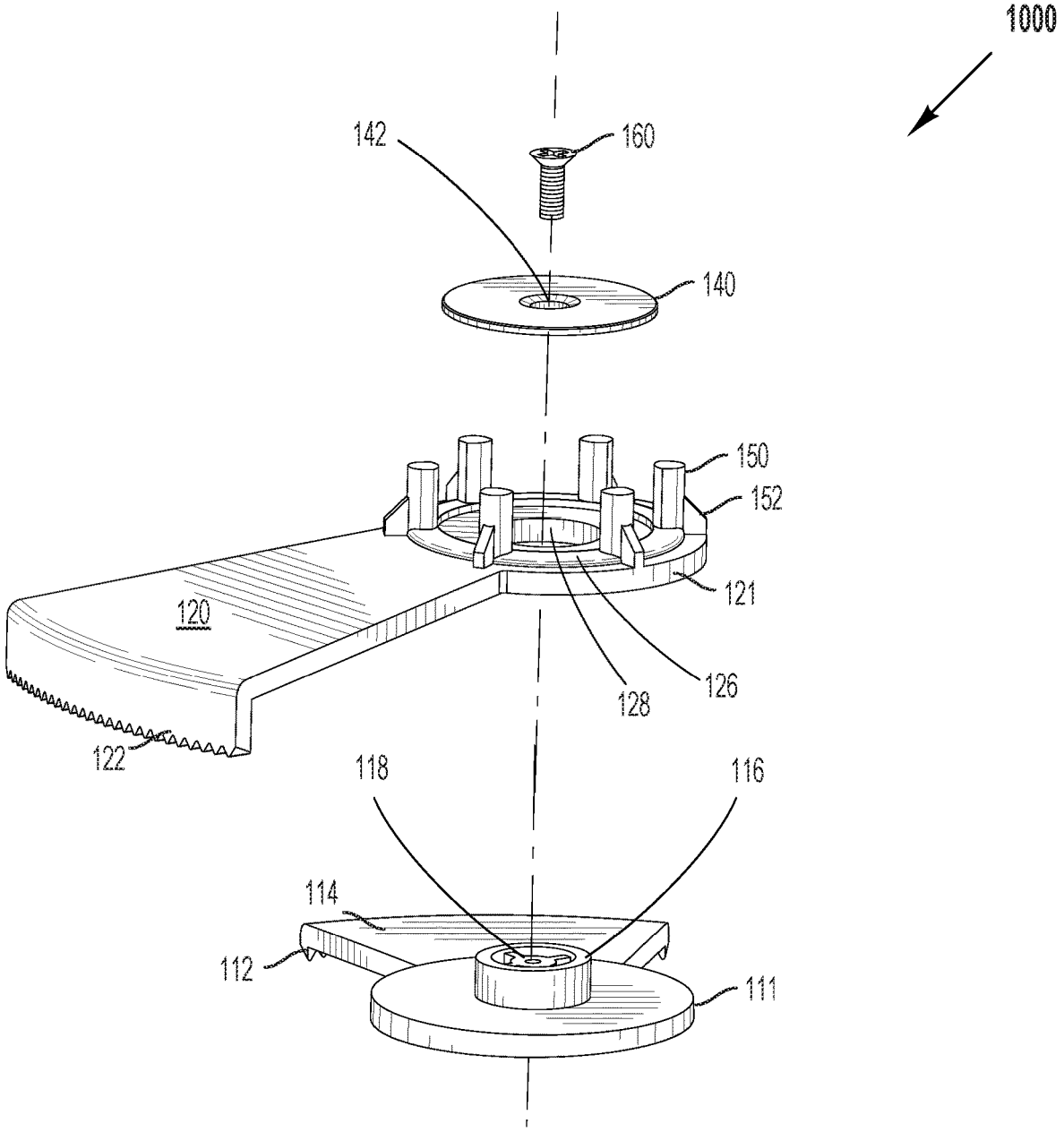
FIG. 3 is a exploded perspective view of the flare stand of FIG. 1.

First, with reference to FIGS. 1 to 3, there is shown a flare stand 1000. The flare stand 1000 comprises a first stand member 110 and a second stand member 120. The first stand member 110 has a base portion 111, and a support portion 114 extending from the base portion 110. The second stand member 120 has a base portion 121 and a support portion 124 extending from the base portion 121. The base portion 121 of the second stand member 120 is pivotally coupled with the base portion 111 of the first stand member 110 and rotatable with respect thereto between an open working position (shown in FIG. 1) in which the flare stand 1000 is configured for supporting a flare on a ground surface and a folded position (shown in FIG. 2) in which the first and second stand members 110 and 120 substantially overlap in the vertical plane for a reduced footprint of the flare stand 1000.

A flare support structure is arranged on the base portion 121 of the second stand member 120 for supporting a flare in a substantially upright position. The first stand member 110 and the second stand member 120 are dimensioned to engage a ground surface such that the flare stand thus maintains flare in the substantially upright position when the flare stand is in the open working position. The flare advantageously maintained in the substantially upright position even in the face of wind, rain, or snow.

In one embodiment, the flare support structure comprises a plurality of upstanding members, such as pegs 150, arranged for receiving an end portion of a flare to support and maintain the flare in a substantially upright position. The plurality of pegs 150 may be disposed on a ring 126 formed or located on a top surface of the second stand member 120. In one embodiment, a support protrusions 152 are disposed adjacent the pegs 150 for providing additional strength thereto. Advantageously, the plurality of pegs 150 frictionally or tightly engage the end portion of the flare, but do not collect water, dirt or salt when the flare stand is used in various road conditions. Other embodiments are contemplated. For example, the flare support structure may comprise any configuration of upstanding members configured to surround and receive a flare. Alternatively, the flare support structure may comprise an upstanding circular wall having a plurality of perforations.

In one embodiment, the flare support structure is preferably arranged to be substantially centrally positioned with respect to the flare stand 1000 in the open working mode, as shown in FIG. 1. This provides added stability to the flare stand 1000.

In one embodiment, the first stand member 110 and the second stand member 120 are substantially planar. While the figures show the first and second stand members being in the shape of a truncated circular sector, other shapes are contemplated. The first and second stand members may, for example be oval, elliptical, triangular, or otherwise. In the embodiment of the FIGS. 1-3, the first and second stand members may have larger dimensions for added stability. For example, they may each be in the form of a quarter of a circle, and in the open working position, the first and second stand members may be angled to one another by ninety degrees.

In one embodiment, the first support portion 114 is angled with respect to the first base support portion 111 and the second support portion 124 is angled with respect to the second base support portion 121 such that the first and second base portions are elevated from the ground surface in the open working position.

In one embodiment, in the folded position the first stand member 110 and the second stand member 120 fully overlap in the vertical plane, and the reduced footprint of the flare stand 1000 is substantially the same as the footprint of one of the first stand member 110 and the second stand member 120.

In one embodiment, the first support portion 114 of the first stand member 110 has a first leg 112 near a distal end portion thereof, and the second support portion 124 of the second stand member 120 has a second leg 122 near a distal end portion thereof. The first leg 112 and the second leg 122 support the flare stand on the ground surface in the open working mode. In one embodiment, the first leg 112 and the second leg 122 each comprises a plurality of teeth configured to grip the ground surface on which the flare stand 1000 is placed. Advantageously, gripping the ground causes the flare stand 1000 to more likely stay in place even in the face of wind, rain, snow or other weather conditions. In one embodiment, the plurality of teeth of the first leg 112 and the second leg 122 are disposed along a periphery of the distal end portion of the respective support portions 114 and 124.

In one embodiment, the base portion 121 of the second stand member 120 comprises a circular aperture 128, and the base portion 111 of the first stand member 110 comprises a circular protrusion 116 sized to fit in the circular aperture 128 to form a pivot connection between the first stand member 110 and the second stand member 120.

In one embodiment, a fastening assembly is configured for pivotally securing the second stand member 120 to the first stand member 110. In one embodiment, the fastening assembly comprises a flare support plate 140 having a central hole 142. The flare support plate 140 is sized to fit into the flare support structure. For example, the flare support plate 140 may be sized to fit into the space formed by pegs 150. The fastening assembly further comprises a fastener, such as a screw 160, which is sized for passing through the central hole 142 and fastening into a hub 118 formed in the circular protrusion 116. In one embodiment, as shown in FIG. 3, in the folded position the first stand member 110 is positioned below the second stand member 120.

In another embodiment of the present disclosure, shown with reference to FIGS. 4-15 there is provided a flare stand 2000 comprising a first stand member 110, a second stand member 120, and a third stand member 130. The first stand member 110 has a base portion 111 and a support portion 114 extending from the base portion. The second stand member 120 has a base portion 121 and a support portion 124. The third stand member 130 has a base portion 131 and a support portion 134. The base portions 111, 121, and 131 are pivotally coupled with one another. The first stand member 110, the second stand member 120, and the third stand member 130 are rotatable with respect to one another between an open working position in which the flare stand is configured for supporting a flare on a ground surface, and a folded position. In the folded position, the first stand member 110, the second stand member 120, and the third stand member 130 substantially overlap in the vertical plane for a reduced footprint of the flare stand 2000. The flare stand 2000 comprises a flare support structure, arranged on the second stand member 120 for supporting a flare in a substantially upright position. The first stand member 110, the second stand member 120, and the third stand member 130 are dimensioned to engage a ground surface in the open working position to maintain the flare in the substantially upright position.

Figure 15:
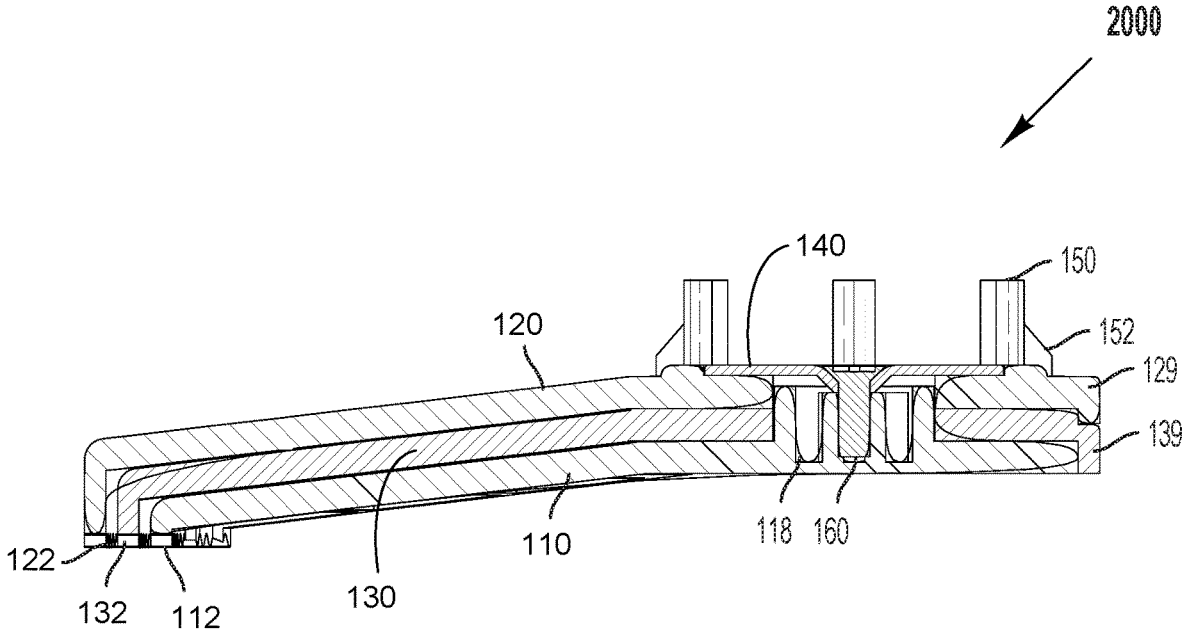
FIG. 15 is a side sectional view of the flare stand of FIG. 14 taken at the line A-A.

In one embodiment, the flare support structure of flare stand 2000 comprises a plurality of upstanding members, such as pegs 150, similar to those of flare stand 1000 described above. In one embodiment, the flare support structure of flare stand 2000 further comprises a plurality of support protrusions 152 similar to those of flare stand 1000 described above. In one embodiment, the flare support structure of flare stand 2000 is arranged to be substantially centrally positioned with respect to the flare stand 2000 in the open working position. In one embodiment, the first stand member 110, the second stand member 120, and the third stand member 130 are substantially planar. In one embodiment, the first support portion 114, the second support portion 124, and the third support portion 134 are angled, with respect to the respective first base portion 111, second base portion 121, and third based portion 131 such that the first, second, and third base portions are elevated from the ground surface in the open working position. This is best seen in FIG. 15.

Figure 13:
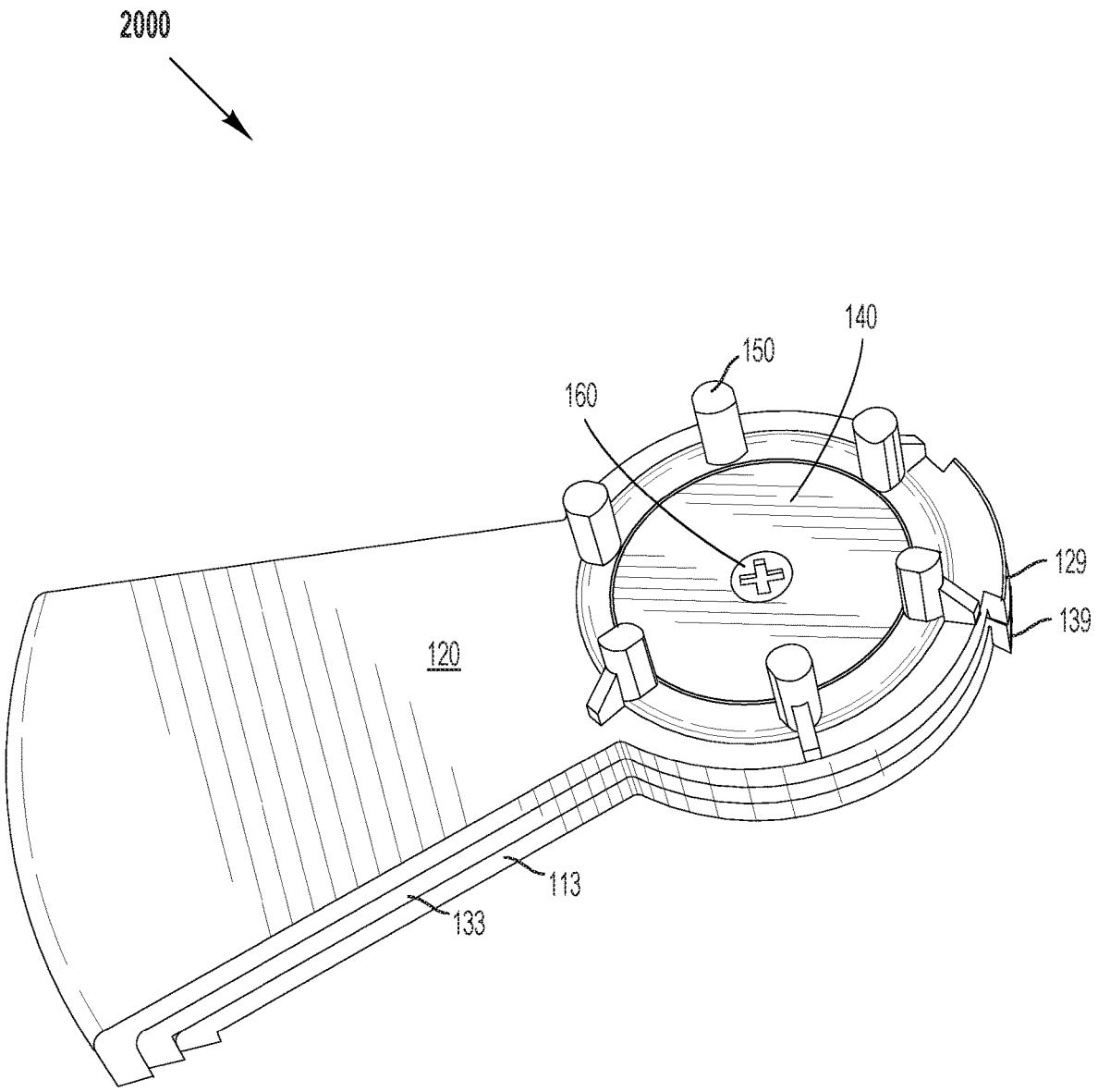
FIG. 13 is a top perspective view of the flare stand of FIG. 4, shown in closed or folded mode.
Figure 14:
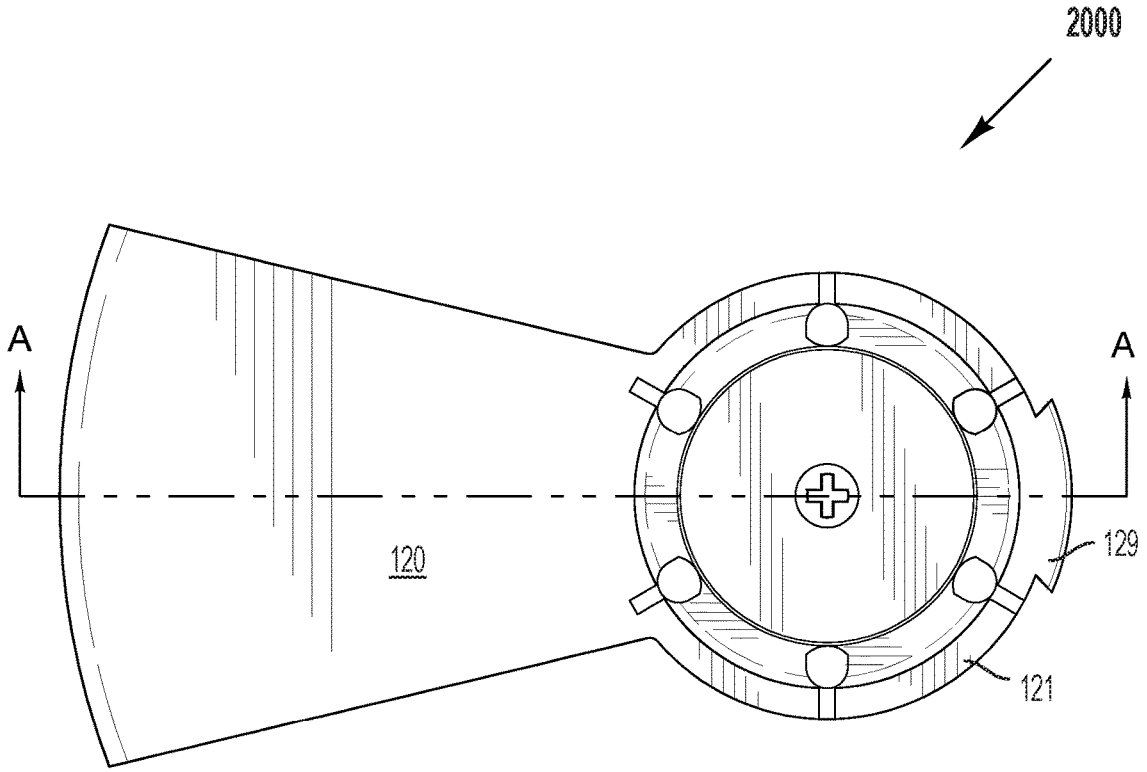
FIG. 14 is a top plan view of the flare stand of FIG. 13.

In one embodiment, in the folded position, shown in FIGS. 13-15, the third stand member 130 is positioned below the second stand member 120, and the first stand member 110 is positioned below the third stand member 130. Additionally, the first stand member 110, the second stand member 120, and the third stand member 130 overlap in the vertical plane such that the reduced footprint of the flare stand 2000 is substantially the same as the footprint of one of the first, second, and third stand members.

The first stand member 110 has a first leg 112 near a distal end of the support portion 114 thereof. The second stand member 120 has a second leg 122 near a distal end of the support portion 124 thereof. The third stand member 130 has a third leg 132 near a distal end of the support portion 134 thereof. The legs 112, 122, and 132, support the flare stand 2000 above ground in the open working position.

In one embodiment, the legs 112, 122, and 132 each comprises a plurality of teeth configured to grip the ground on which the flare stand is placed. In one embodiment, the plurality of teeth is disposed along a periphery of the distal end portion of the first, second, and third support portions 114, 124, and 134.

In one embodiment, in the closed mode, the first stand member 110, the second stand member 120, and the third stand member 130 fully overlap in the vertical plane and the reduced footprint of the flare stand 2000 is substantially the same as the footprint of one of the first stand member 110, the second stand member 120, and the third stand member 130.

In one embodiment, the base portion 121 of the second stand member 120 comprises a circular aperture 128, the base portion 131 of the third stand member 130 comprises a circular aperture 138, and the base portion 111 of the first stand member 110 comprises a circular protrusion 116 sized to fit in the circular apertures 128 and 138 to form a pivot connection between the first stand member 110, the second stand member 120, and the third stand member 130.

In one embodiment, the flare stand 2000 comprises a fastening assembly configured for pivotally securing the first stand member 110, the second stand member 120, and the third stand member 130 to one another. In one embodiment, the fastening assembly comprises a flare support plate 140 having a central hole 142. The flare support plate 140 is sized to fit into the flare support structure. For example, the flare support plate 140 may be sized to fit into the space formed by pegs 150. The fastening assembly further comprises a fastener, such as a screw 160, which is sized for passing through the central hole 142 and fastening into a hub 118 formed in the circular protrusion 116.

Figure 4:
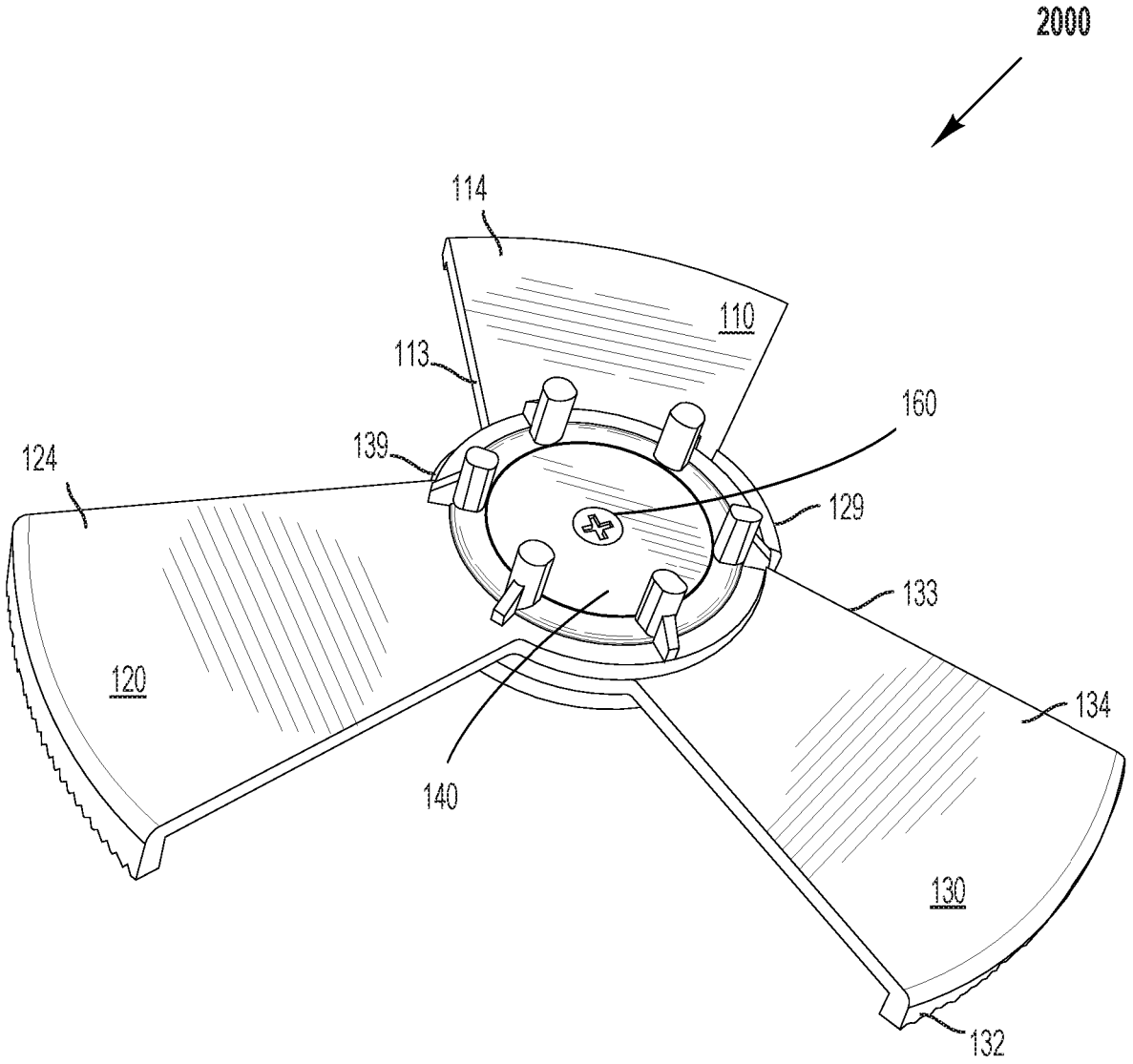
FIG. 4 is a top perspective view of a flare stand having three stand members in an open mode, in accordance with another embodiment of the present disclosure.

In one embodiment, the second stand member 120 comprises a first stop means 129 for stopping the third stand member 130 at a specific position in the open working position when the third stand member is pivotally moved from the folded position to the open working position. With reference to FIG. 4, it can be seen that edge 133 of the support portion 134 of the third stand member 130 abuts the stop member 129. Accordingly, the stop member 129 stops the third stand member 130 at that position.

Figure 5:
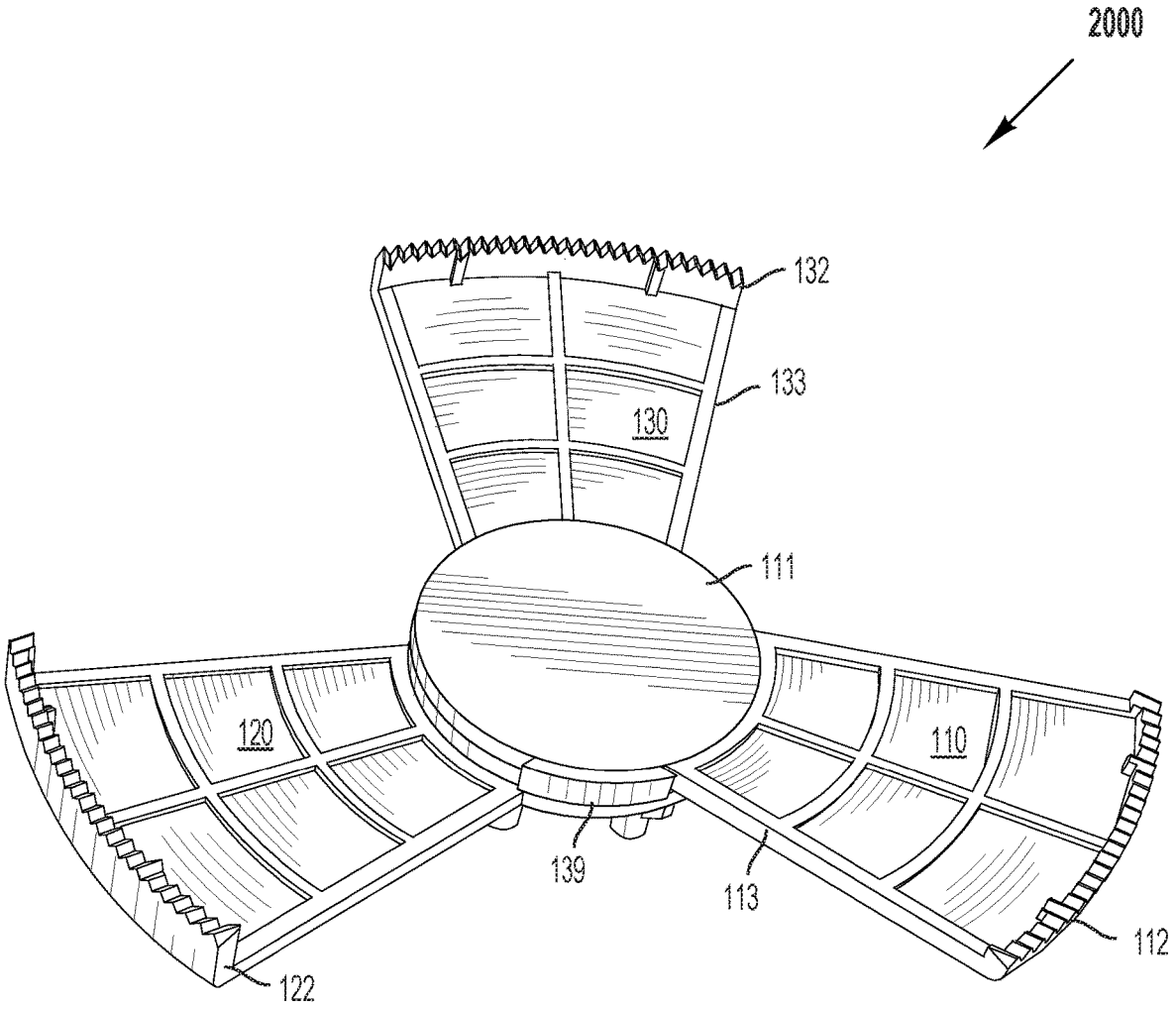
FIG. 5 is a bottom perspective view of the flare stand of FIG. 5.
Figure 6:
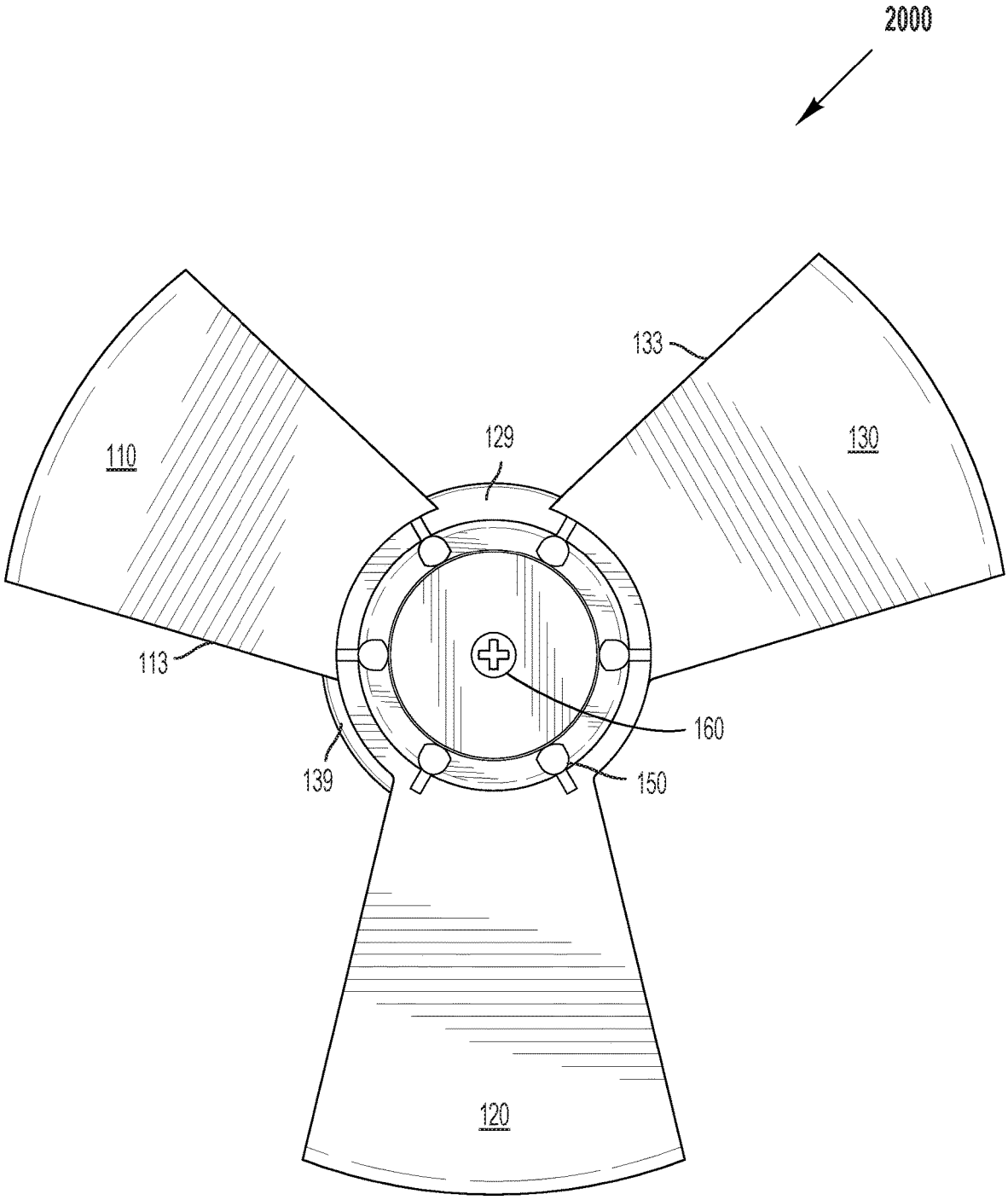
FIG. 6 is a top plan view of the flare stand of FIG. 4.
Figure 7:
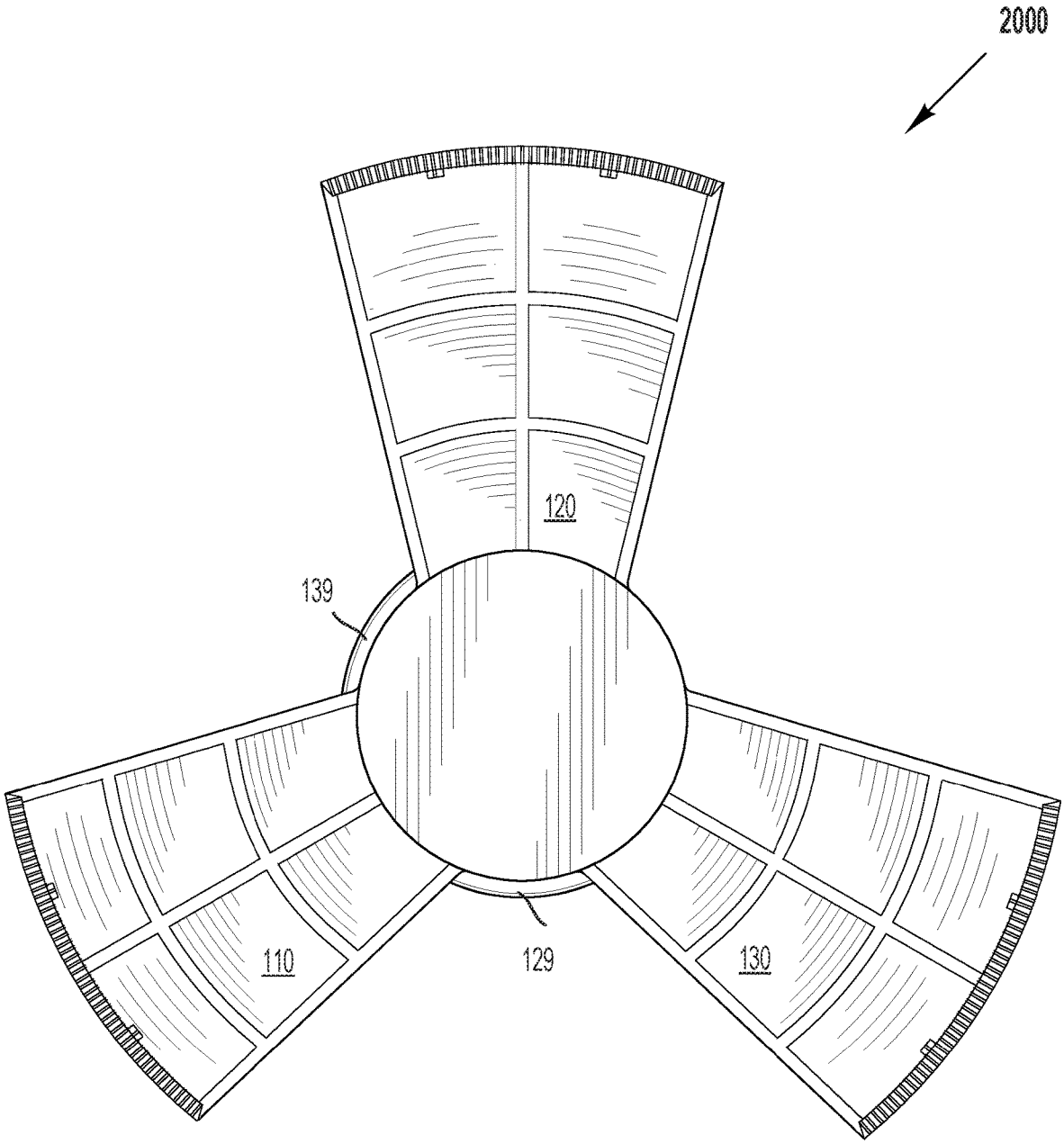
FIG. 7 is a bottom plan view of the flare stand of FIG. 6.
Figure 8:
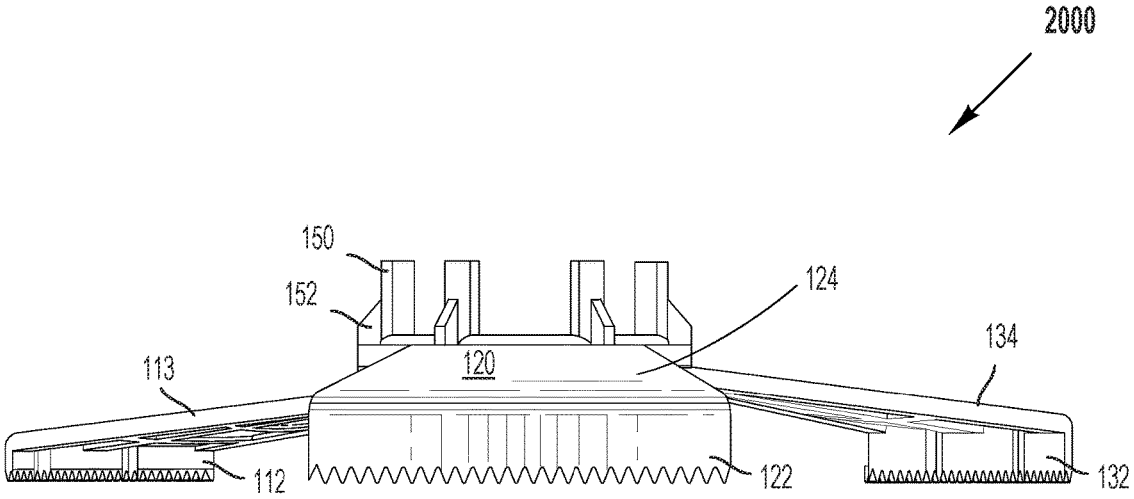
FIG. 8 is a front elevation view of the flare stand of FIG. 6.
Figure 9:
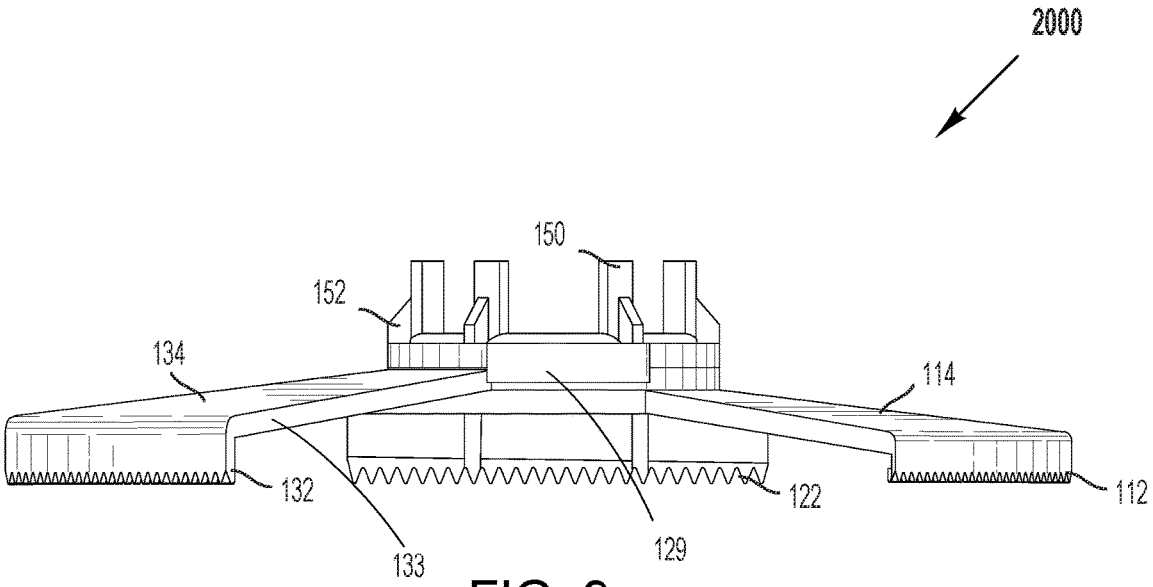
FIG. 9 is a rear elevation view of the flare stand of FIG. 6.
Figure 10:
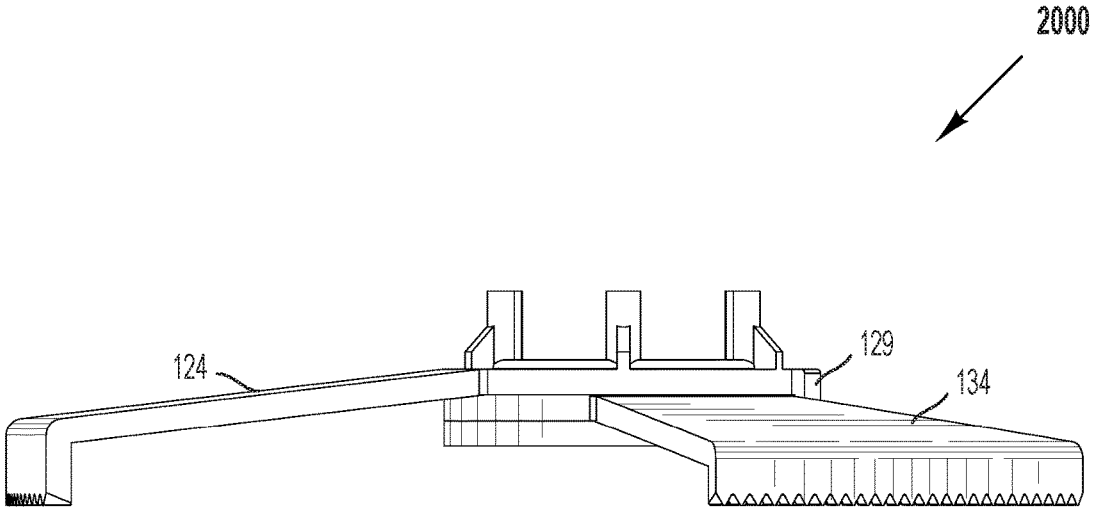
FIG. 10 is a right side elevation view of the flare stand of FIG. 6.
Figure 11:
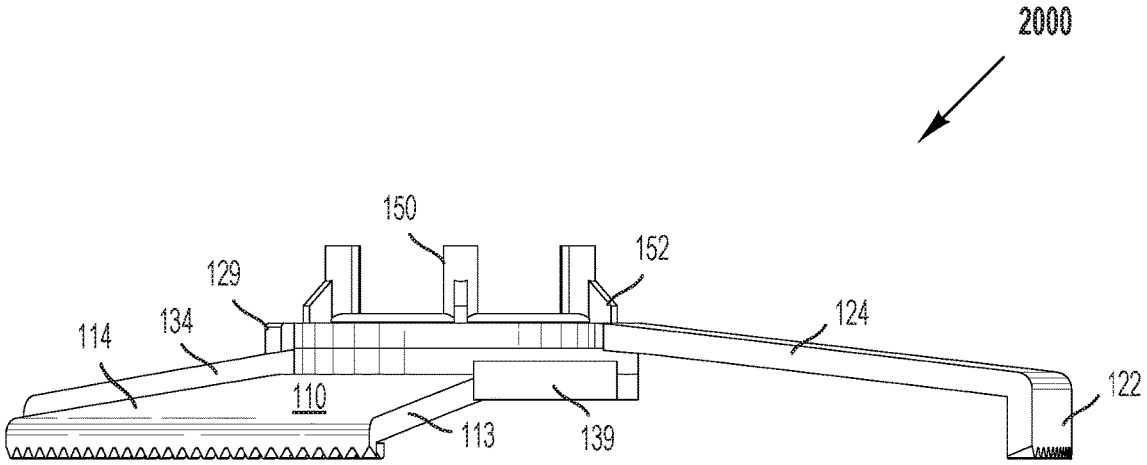
FIG. 11 is a left side elevation view of the flare stand of FIG. 6.
Figure 12:
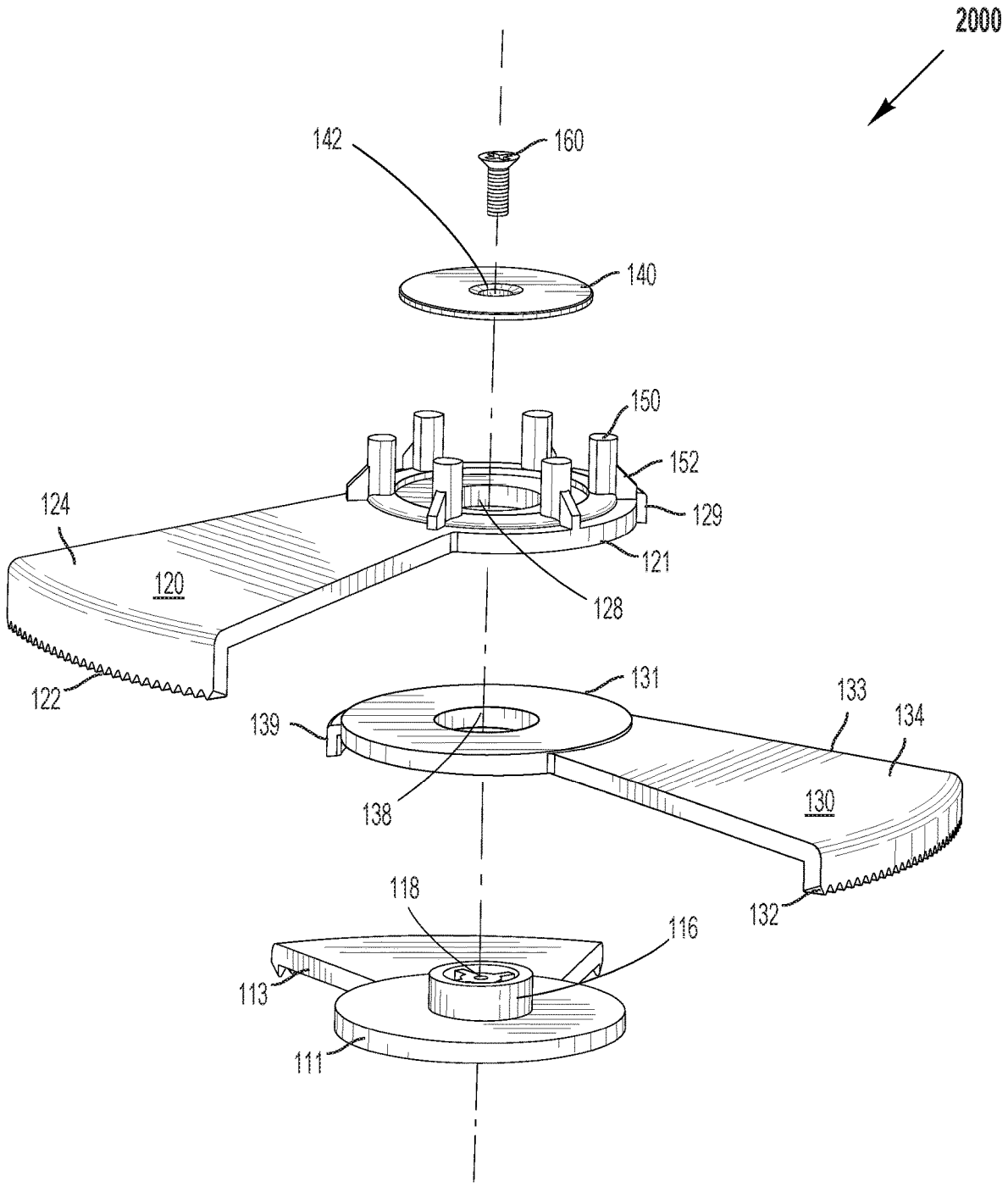
FIG. 12 is an exploded perspective view of the flare stand of FIG. 4.

In one embodiment, the third stand member comprises a second stop means 139 for stopping the first stand member 110 at a specific position in the open working position when the first stand member 110 is pivotally moved from the folded position to the open working position. With reference to FIG. 5, it can be seen that edge 113 of the support portion 114 of the first stand member 110 abuts the stop member 139. Accordingly, the stop member 139 keeps the first stand member 110 at that position.

The above-described embodiments are intended to be examples of the present disclosure and alterations and modifications may be effected thereto, by those of skill in the art, without departing from the scope of the invention, which is defined solely by the claims appended hereto.

The invention claimed is:

1. A flare stand, comprising:

a) a first and a second stand members each having a base portion and a support portion extending radially in a single direction from the base portion, the base portion of the second stand member being pivotally coupled with the base portion of the first stand member and rotatable with respect thereto between an open working position in which the flare stand is configured for supporting a flare on a ground surface, and a folded position in which the support portions of the first and second stand members are atop one another whilst said base portions are pivotally coupled for a reduced footprint of the flare stand;

b) a flare support structure, arranged on the base portion of the second stand member and configured for supporting a flare in a substantially upright position; and c) wherein the first and second support portions are dimensioned to engage the ground surface such that the flare stand maintains the flare in the substantially upright position when the flare stand is in the open working position.

2. The flare stand of claim 1, wherein the flare support structure comprises a plurality of upstanding members arranged for receiving an end portion of the flare to maintain the flare in the substantially upright position.

3. The flare stand of claim 1, wherein the flare support structure is arranged to be substantially centrally positioned with respect to the flare stand in the open working position.

4. The flare stand of claim 1, wherein the first and second support portions are substantially planar.

5. The flare stand of claim 1, wherein the first and second support portions are angled with respect to the respective first and second base portions, such that the base portions of the first and second stand members are elevated from the ground surface in the open working position.

6. The flare stand of claim 1, wherein in the folded position the first and second stand members overlap in the vertical plane such that the reduced footprint of the flare stand is substantially the same as a footprint of one of the first and the second stand members.

7. The flare stand of claim 1, wherein the first and second support portions each comprises at least one leg for supporting the flare stand on the ground surface in the open working mode.

8. The flare stand of claim 7, wherein the at least one leg comprises a plurality of teeth configured to grip the ground surface on which the flare stand is placed.

9. The flare stand of claim 8, wherein the plurality of teeth are disposed along a periphery of a distal end portion of the support portion of each of the first and the second stand members.

10. The flare stand of claim 9, wherein the base portion of the second stand member comprises a circular aperture, and the base portion of the first stand member comprises a circular protrusion sized to fit in the circular aperture to form a pivot connection between the first and second stand members.

11. The flare stand of claim 9, further comprising a fastening assembly configured for pivotally securing the second stand member to the first stand member.

12. The flare stand of claim 11, wherein the fastening assembly comprises:

a) a flare support plate having a central hole, and sized to fit within the flare support structure; and b) a fastener, sized for passing through the central hole and fastening into a hub formed in the circular protrusion.

13. The flare stand of claim 1, wherein in the folded position mode the first stand member is positioned below the second stand member.

14. The flare stand of claim 1, further comprising a third stand member having a base portion and a support portion extending radially in a single direction from the base portion, the base portion of the third stand member being pivotally coupled with the base portion of each of the first and second stand members.

15. The flare stand of claim 14, wherein in the folded position: the third stand member is positioned below the second stand member and the first stand member is positioned below the third stand member.

16. The flare stand of claim 14, wherein the first, second and third stand members each comprises at least one leg near a distal end portion of the support portion thereof for supporting the flare stand above ground in the open working position.

17. The flare stand of claim 16, wherein the at least one leg comprises a plurality of teeth configured to grip the ground surface on which the flare stand is placed.

18. The flare stand of claim 17, wherein the plurality of teeth are disposed along a periphery of the distal end portion of the support portion of each of the first, second, and third stand members.

19. The flare stand of claim 14, wherein in the folded position the first, second and third stand members fully overlap in the vertical plane and the reduced footprint of the flare stand is substantially the same as the footprint of one of the first, second and third stand members.

20. The flare stand of claim 14, wherein the second stand member further comprises a first stop means for stopping the third stand member at a specific position in the open working position when the third stand member is pivotally moved from the folded position to the open working position.

21. The flare stand of claim 14, wherein the third stand member further comprises a second stop means for stopping the first stand member at a specific position in the open working mode position the first stand member is pivotally moved from the folded position to the open working position.

* * * * *